United States Patent [19]

Gipprich

[11] 4,205,282

[45] May 27, 1980

[54] PHASE SHIFTING CIRCUIT ELEMENT

[75] Inventor: John W. Gipprich, Reistertown, Md.

[73] Assignee: Westinghouse Electric Corp., Pittsburgh, Pa.

[21] Appl. No.: 935,284

[22] Filed: Aug. 21, 1978

[51] Int. Cl.[2] ..... H01P 3/08; H01P 1/18; H01P 9/00; H01P 5/16

[52] U.S. Cl. ..... 333/161; 333/103; 333/125; 333/164

[58] Field of Search ..... 333/156, 160, 161, 117, 333/164, 101, 103, 104, 124, 125, 246, 247

[56] References Cited

U.S. PATENT DOCUMENTS

| | | | |
|---|---|---|---|
| 3,423,699 | 1/1969 | Hines | 333/164 |
| 3,916,349 | 10/1975 | Ranghelli et al. | 333/156 X |
| 4,105,959 | 8/1978 | Stachejko | 333/161 |

*Primary Examiner*—Alfred E. Smith
*Assistant Examiner*—Marvin Nussbaum
*Attorney, Agent, or Firm*—W. E. Zitelli

[57] ABSTRACT

An electrical phase shifting circuit element of the reflection type including a quadrature coupler branch network, a matched pair of selectively coupled transmission lines and an electrical switching element corresponding to each pair of transmission lines, all being separated distributively from each other and a ground plane by a dielectric material, is disclosed. One end of one transmission line of each pair is connected to a corresponding phase splitting port of the quadrature coupler and another end of the other transmission line of each pair is coupled to the switching element which is preferably a pin diode. The pin diodes may be governed by a common switching signal to electrically connect and disconnect the another ends of the other transmission lines to the ground plane. The transfer between the connecting and disconnecting states renders a phase shift to the RF signal at the output port of the quadrature coupler, the magnitude and direction of the rendered phase shift being a function of the selected coupling of the transmission line pairs. More specifically, one transmission line of each pair may have a preset length of approximately one-quarter wavelength of the desired frequency of the input RF signal and the length of the other line in each pair may be selected in the range of 0 to the one-quarter wavelength dimension. The magnitude and direction of the phase shift in the output RF signal caused by the transfer of states of the electrical switching element is based on the selected length of the other transmission line in each pair.

20 Claims, 8 Drawing Figures

| X | Y |
|---|---|
| 0 | 0 |
| 10 | 3 |
| 20 | 7 |
| 30 | 12 |
| 40 | 20 |
| 50 | 29 |
| 60 | 49 |
| 70 | 80 |
| 80 | 125 |
| 90 | 180 |

PHASE SHIFTING CIRCUIT ELEMENT

GOVERNMENT CONTRACT CLAUSE

The invention herein described was made in the course of or under a contract bearing number F-33615-76-C-1279 or subcontract thereunder with the Department of the Air Force.

BACKGROUND OF THE INVENTION

The present invention relates to phase shifters in general, and more particularly, to a phase shifter circuit element including a matched pair of coupled transmission lines which cooperate with a quadrature coupler branch network and a pair of symmetric reflecting pin diode terminations to effect phase shift switching speeds on the order of a few nanoseconds, the coupling of said transmission line pairs being selectable to offer a variety of phase shift values.

In some high resolution mapping type radar systems, digitally controlled phase shifters are included in the sampling linearizers of the linear FM (chirp) waveform generator of the radar system to achieve the range resolution required. For a more detailed description of a sampling linearizer utilizing a phase shifter, reference is hereby made to the U.S. patent application Ser. No. 935,240, now U.S. Pat. No. 4,160,956 which is filed concurrently herewith and assigned to the same assignee as the present application. The phase shifting elements which are responsive to the digital control bits of the sampling linearizer are normally required to operate to shift the phase of a signal conducted therethrough at very high switching speeds. Typical desired sampling times are on the order of 25 nanoseconds or less in some instances. To achieve reasonable steady state conditions over the sampling interval, switching speeds on the order of a few nanoseconds may be required in some cases.

At the present time, most applications of a phase shifting circuit element are best met using a three dB quadrature coupler 10 with symmetric reflecting diode terminations 12 as depicted in FIG. 1. The incident voltage $V_G$ of the input RF signal at port 1 of the coupler 10 is transmitted to the phase splitting ports 2 and 3 of the coupler 10 with voltages of equal magnitude but with a phase difference of 90°. The voltages refected at the terminations (see 14 and 16) remain 90° out of phase since the terminations are identical. The reflected voltages are each transmitted through the coupler 10 where they are recombined at an output port 4. Since the output voltage $V_T$ at output port 4 consists only of two reflected waves, the phase shift at the output is equal to the phase shift provided by the reflective terminations.

The phase shift achieved at the reflective terminations depends on the particular characteristics of the pin dioder 18 and 20 as well as the nature of the reactive matching networks 22 and 24. To a first approximation, the pin diode acts as a switch which is alternated between a low impedance and a high impedance state when operated respectively between forward and reverse bias states as governed by the voltage supplied at point 26. An ideal diode would alternately look like a short and open circuit, therefore shifting phase by 180°. Other values of phase shifts are achieved by reactively trimming the reactive networks 22 and 24.

There are a number of ways in which the reactive trimming may be achieved. When dealing with microwave frequencies, distributed circuit elements are most commonly used. Typical distributed elements are shorted and open circuited stubs and/or sections of transmission line. One commonly used matching network (and perhaps the simplest) is the network shown in FIG. 2. A one eighth-wavelength section of line 30, for example, transforms an ideal diode 32 (whose phase shift is 180°) to an impedance of $\pm/JZ_T$ which produces a phase shift of $2\tan^{-1}(Z_T/Z_O)$. The particular choice of reactive trimming depends on the phase shift desired, the frequency bandwidth and the range of realizable impedances.

A multi-bit phase shifter may be obtained by cascading several of these known phase shifter networks as shown in FIG. 3. Each phase shifting element is substantially identical except for the reactive matching networks 34 and 36 which determine the particular phase shift of each phase shifting element. The inter-section capacitors 38 are used to couple the RF signals from one element to the next, and to decouple each phase shifting element so that each may be switched independently from the other.

The general problem of switching a reflection-type diode phase shifter is to provide a circuit which allows for applying the appropriate bias to the diodes without affecting the RF transmission properties of the phase shifter network. FIG. 4 illustrates a general block diagram schematic of a typical phase shifter element. A low pass (or RF band stop) filter 40 located between the diode 42 and the diode driver 44 must allow the bias voltage/current $I_b$ to be applied to the diode 42 and act as a very high impedance to the RF frequencies. A high pass (or RF bandpass) network 46 must allow for the RF signals to reach the diode 42 without affecting the phase shift properties of the phase shifting circuit and to isolate the bias signals generated by the drivers 44 from the rest of the RF network. At low switching rates, a series capacitor in the RF line is usually sufficient. The capacitance is chosen high enough to provide a very low impedance to the RF frequencies and yet sufficient enough to block the diode bias signals.

At high switching rates, where the frequencies of the switching pulse approach the RF or carrier frequency, as that needed for the sampling linearizer of the FM generation system of a high resolution mapping radar, for example, simple blocking capacitors no longer suffice. In order that the driver pulse be allowed to rise quickly, extraneous capacitances in the form of RF bypass elements must not be excessive. This problem may be solved by providing more sophisticated filtering with sharper cut-off properties or by utilizing the high impedance properties necessary at the switching frequency as part of the RF reactive phase matching. The phase shifting circuit element disclosed hereinbelow offers these characteristics.

SUMMARY OF THE INVENTION

An electrical phase shifting circuit includes a quadrature coupler branching network having input and output ports for coupling an RF signal therethrough and first and second phase splitting ports for coupling two matched reflective termination networks respectively thereto. In accordance with the principals of the present invention, each matched reflective termination network comprises a pair of selectively coupled transmission lines which are separated distributively from each other and from a first voltage potential, preferably ground, by a dielectric material having a predetermined dielectric constant, the pair of transmission lines having a first and second end, the first end of one of the transmission lines of the pair being coupled to the phase splitting port corresponding thereto; an electrical switching element, preferably a pin diode, operative to connect and disconnect the second end of the other transmission line of the pair to and from a second voltage potential, preferably ground, in accordance with first and second switching states, respectively as governed by a switching signal, the connecting and disconnecting of the other transmission line to and from the second voltage potential rendering a phase shift of the RF signal at the output port of the quadrature coupler, the magnitude and direction of the phase shift being a function of the selected coupling of the pair of transmission lines; and a filtering circuit for providing mutual electrical decoupling between the switching signal governing the switching element and the RF signal conducted through the phase shifting circuit element. A desired phase shift may be rendered at the output port of the quadrature coupler network as a result of the connecting and disconnecting of the second end of the matched pair of transmission lines to and from the second voltage potential by selecting a desired length of one transmission line of each pair of transmission lines with respect to the preset length of the other transmission line of each pair.

More specifically, at least one transmission line in each pair of transmission lines is substantially equal to one-quarter wavelength of the desired frequency of the input RF signal. The other transmission line in each pair may be selected to have a desired length in the range of 0 to the one-quarter wavelength dimension. Accordingly, the phase shift of the RF signal at the output port of the quadrature coupler rendered by the transfer of states of the switching element has a magnitude and direction relative to the desired length selected for the other transmission line in each pair of transmission lines. Furthermore, the switching elements of the matched reflective termination networks may be governed concurrently by the same switching signal. Still further, the phase switching circuit element includes an input electrical junction for receiving the common switching signal. The filtering circuit of the matched reflective termination networks comprises a high impedance line for coupling the electrical junction with each second end of the other transmission line of each pair of transmission lines; and a low impedance stub which is coupled at one end to the electrical junction. Both the high impedance lines and the low impedance stub are preferably at a length of one-quarter wavelength of the desired frequency of the input RF signal and are both separated distributively from each other and from the quadrature coupler, the pairs of transmission lines and the first and second voltage potentials by the dielectric material.

In accordance with one structure of the present invention, a first layer of conducting material may have one surface of a second layer of dielectric material of a predetermined dielectric constant contiguous therewith. The other surface of the second layer has disposed thereon in a stripline circuit configuration the quadrature coupler branch network, the two matched pairs of transmission lines, the electrical junction, and the filter circuit comprised of the high impedance lines and low impedance stub. A pin diode corresponding to each pair of transmission lines is disposed in the dielectric material in close proximity to the second end of the transmission line pair corresponding thereto, the cathode end of each diode being electrically coupled to said first layer and the anode end being electrically coupled to the second end of the other transmission line of the pair corresponding thereto. The high impedance lines of the filter circuit provide the electrical connection between the electrical junction and the second end of the other transmission lines of each pair of transmission lines and the low impedance stub section extends along the other surface of the second layer from the electrical junction substantially in parallel with the pairs of transmission lines, the extension distance being approximately the one-quarter wavelength dimension.

DESCRIPTION OF THE PREFERRED EMBODIMENT

Figure 1:
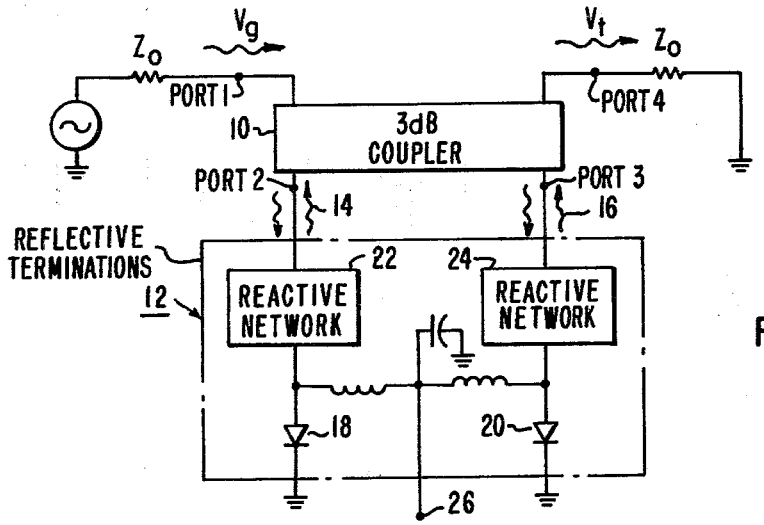
FIG. 1 is a functional block diagram of a typical phase shifter circuit.
Figure 2:
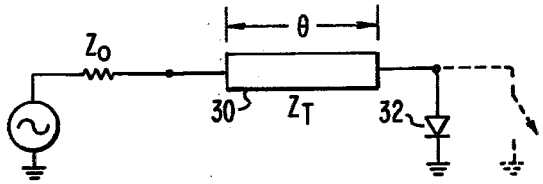
FIG. 2 is an elemental schematic circuit diagram depicting the operation of a switched matching network.
Figure 3:
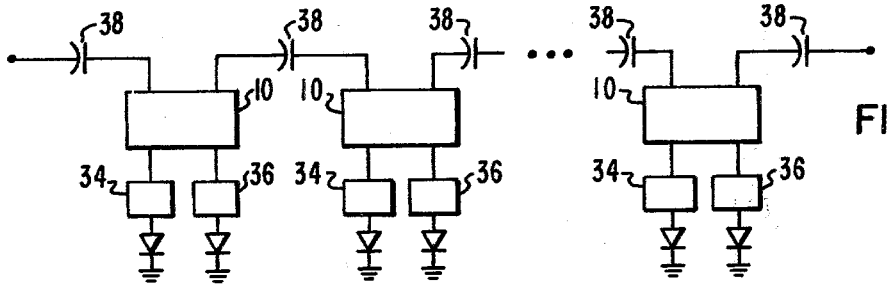
FIG. 3 displays a multi-bit phase shifter comprised of a plurality of cascaded phase shifting circuits similar to the type depicted in FIG. 1.
Figure 4:
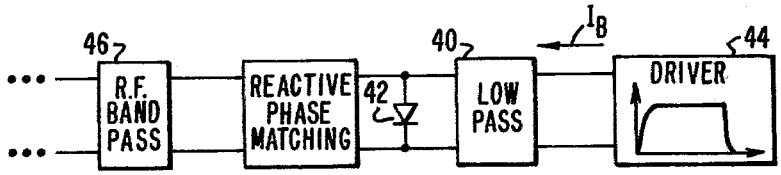
FIG. 4 is a functional block diagram illustrating the operation of a phase shifter circuit.
Figure 5:
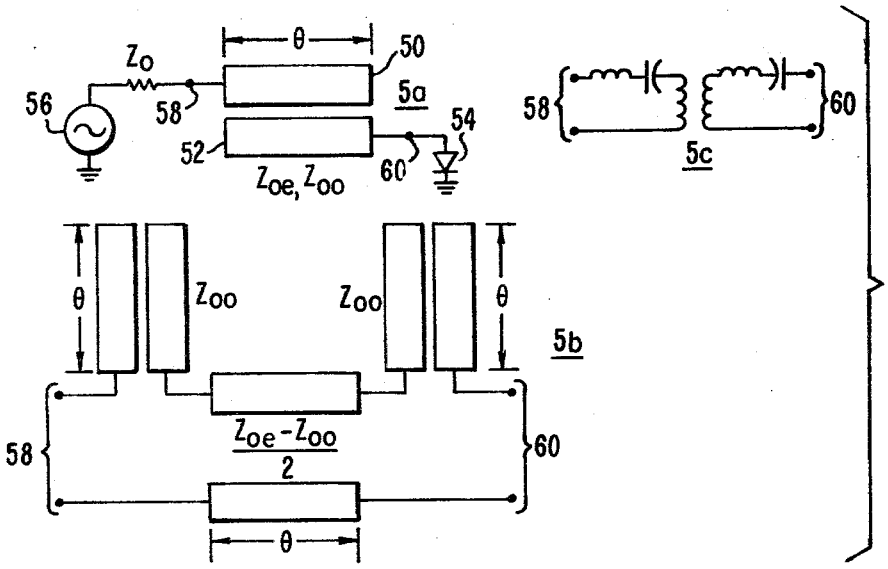
FIG. 5 depicts the principal of operation of applicant's phase shifting network.

The principals of the operation of a phase shift matching network suitable for use in the preferred embodiment is simply shown in FIG. 5. A pair of coupled transmission lines 50 and 52 are coupled between a diode 54, which may be of the pin diode type, and a microwave signal generator 56 as shown simply in FIG. 5A. With ports 58 and 60 open circuited, the distributed and lump circuit equivalents of the coupled line of the phase shift matching network of FIG. 5A are shown in FIGS. 5B and 5C, respectively. The dual transmission line circuit of FIG. 5A is equivalent to a two-pole bandpass filter which is resonant at the frequency at which the line lengths 50 and 52 are ¼-wavelength of the desired frequency of the input RF signal. The bandpass characteristics and the out of band rejection properties depend on the even mode $Z_{oe}$ and odd mode $Z_{oo}$ impedances which are a function of how tightly the lines are coupled. By adjusting the coupling property, high impedance may be achieved out of band very close to the resonant frequency. It is this principal which is utilized to attain the operation of a phase shifter at switching frequencies close to the RF or carrier frequency.

One of the advantages of the coupled line network 50–52 of FIG. 5 is that phase shifts of any value between 0° and 180° may be realized. If the length of the coupled lines is equal to a ¼-wavelength of the desired frequency of the input RF signal (i.e., 74=90° ), the network acts as an impedance transformer. If an ideal diode terminates the circuit, a phase shift of 180° is maintained regardless of the coupling. As one of the line lengths 50 or 52 is made shorter with respect to the other which may be left at the ¼-wavelength dimension, phase shifts of less than 180° result. The particular amount of phase shift depends on the coupling of the lines 50 and 52 which may be effected by changing the length of one of the transmission lines 50 or 52. Zero degrees phase shift results if either of the line lengths 50 or 52 are reduced to 0 or if the lines are completely uncoupled.

Figure 6:
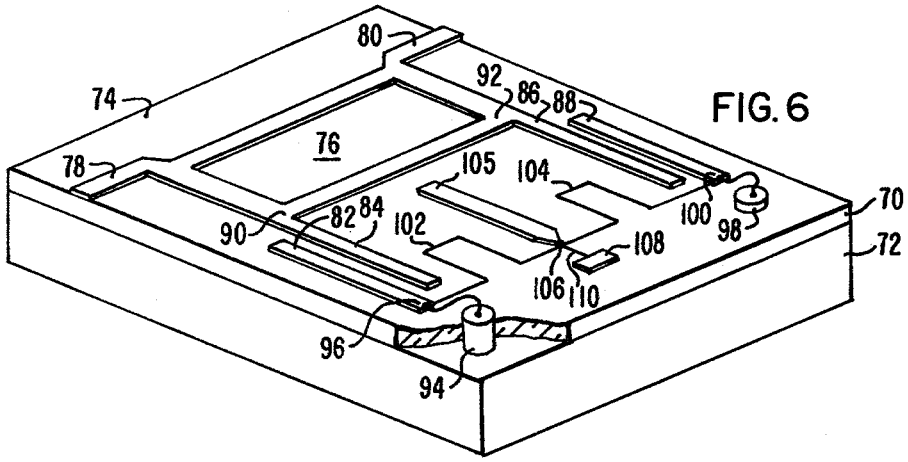
FIG. 6 depicts a suitable structural embodiment of applicant's phase shifting circuit.

A suitable structural embodiment of the disclosed phase shifter circuit element is shown in FIG. 6. Stripline or microstrip circuit techniques were utilized in the assembly process. A layer of dielectric material 70 is disposed on a conventional metal carrier 72. A thickness and dielectric constant of the dielectric material 70 found suitable for the purposes of this embodiment may be on the order of 0.015 inches and 10.2, respectively. Disposed on the surface 74 of the dielectric substrate 70, which is opposite the surface in contact with the metal carrier 72, is a conventional branch line quadrature coupler at 76 fabricated in a well-known manner as a printed stripline circuit. An input RF signal may be supplied to port 1 at 78 of the coupler 76 and an RF signal may be coupled out of the coupler 76 from port 4 at 80. In accordance with the principals of the invention, two coupled parallel line pairs 82–84, and 86–88 are disposed on the surface 74 of the dielectric layer 70, one line 84 of the coupled line pair 82–84 is coupled to port 2 of the coupler 76 at 90. Similarly, one line 86 of the coupled pair 86–88 is coupled to port 3 of the coupler 76 at 92. The widths of each of the coupled lines 82, 84, 86 and 88 may be on the order of 0.007 inches for the present embodiment. A suitable separation of each of the coupled line pairs 82–84 and 86–88 was approximately 0.003 inches. The lengths of the coupled lines 82, 84, 86 and 88 may be made ¼-wavelengths of the desired frequency of the input RF signal. However, it is understood that the lengths of the lines may be shortened to another length to achieve the coupling necessary to cause a desirable phase shift of the signal conducted through the phase shift circuit element.

A pin diode 94 which may be of the type manufactured by Alpha having a model number 7002–04 being a fast switching type diode, is disposed in the dielectric material 70 in a vicinity in the end 96 of the coupled line pair 82–84 which is opposite the end coupled at 90. Another similar pin diode 98 is likewise disposed in the dielectric material 70 in the vicinity of the end 100 of the coupled line pair 86–88 which is opposite the end coupled at 92. The anodes of the pin diodes 94 and 98 may be coupled to the ends of the circuit lines 82 and 88 denoted by 96 and 100, respectively, with metal ribbons, for example. The cathodes of both of the pin diodes 94 and 98 may be shunt mounted to the metal carrier layer, which may be at ground potential, through holes provided in the dielectric layer 70.

Two high impedance quarter wavelength lines 102 and 104 are disposed on the surface 74 in a well-known configuration. One end of each of the lines 102 and 104 may be coupled to the transmission line 82 at 96 and the transmission line 88 at 100, respectively. The other end of each of the lines 102 and 104 may be coupled together at a junction 106 located on the surface 74 at a point approximately midway between points 96 and 100. In addition, a low impedance stub section 105 may be disposed on the surface 74 having one end coupled to the junction 106 and extending about a distance of approximately a quarter wavelength of the desired frequency of the input RF signal on the surface 74 in the area between the transmission line pairs 82–84 and 86–88 and lying approximately parallel thereto. Further, a metal pad 108 is disposed on the surface 74 and coupled to the junction 106 by a line 110. The pad 108 provides a means for receiving a switching signal to operate the diodes in either a conduction or non-conduction state. The switching signal may be derived in a current driver (not shown), similar to the type Optimax DS-07 solid state switching driver, and connected to the phase shifter element in a manner well known in the art for switching the diodes 94 and 98 between forward (conducting) and reverse (non-conducting) bias states.

Figure 7:
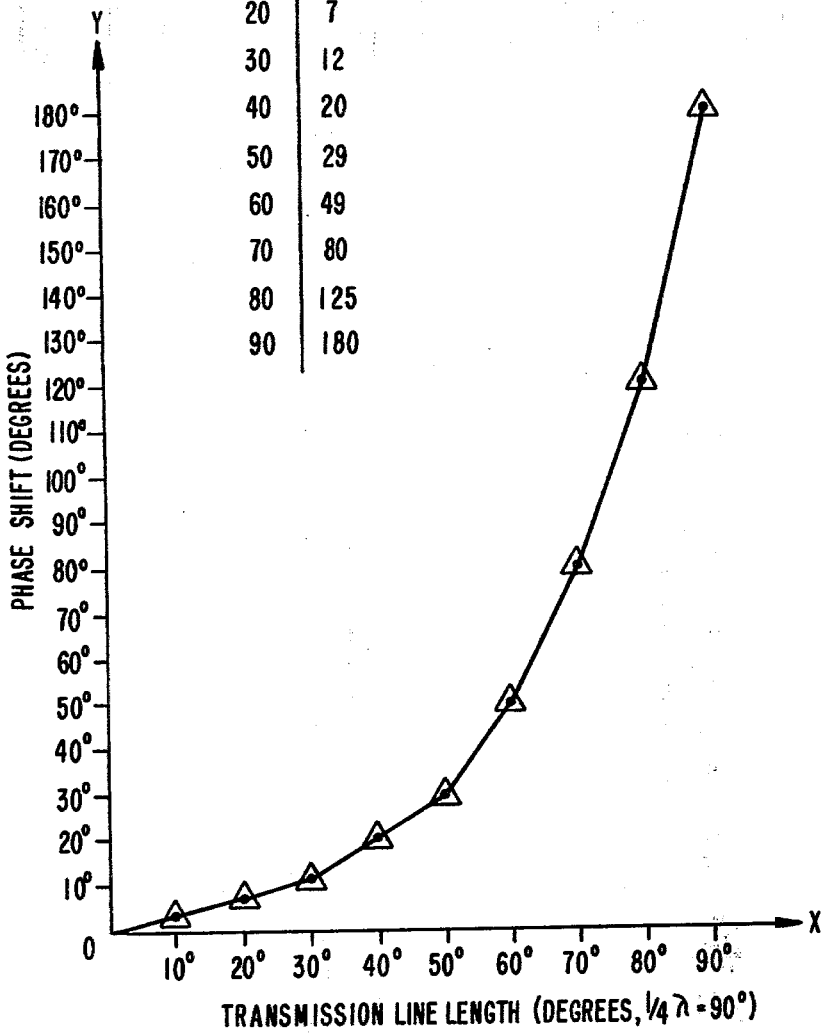
FIG. 7 is a graph exemplifying the relationship between phase shift and transmission line length for an embodiment similar to that shown in FIG. 6.

The structural embodiment described in connection with FIG. 6 was designed to operate at a carrier frequency of 1.2 GHz and as shown may provide a 180° phase shift on the output RF signal imposed by the transfer of states between forward and reverse bias or vice versa of the diodes 94 and 98. It is understood that this design is only an exemplary embodiment of applicant's invention and that other dimensions and characteristics may be used to allow operation of the device at other carrier frequencies, for example. Furthermore, the dimensions of transmission lines 84 and 86 may be altered in length with respect to their adjacent parallel coupled line 82 and 88 which may be maintained at the ¼-wavelength dimensions as one possible method of changing the transmission line coupling to arrive at another desired phase shift for the element. An example of the phase shift achievable in accordance with transmission line length alteration of the matched impedance networks is shown in the graph of FIG. 7. The characteristics of the phase shifter which were used in deriving the graph of FIG. 7 are a W/H of 0.4, an S/H of 0.2, and a dielectric constant of 10 wherein W is the width of each of the transmission lines, H is the thickness of the dielectric layer, and S is the separation between the coupled transmission line pairs. Accordingly, it is further understood that other graphs similar to the one of FIG. 7 may additionally be derived for other sets of characteristics which may be required for other specifications.

In operation, an RF signal may be supplied to port 1 at 78 of the quadrature coupler 76. This RF signal is phase split by 90° to supply incident RF signals at ports 2 and 3 (i.e., 90 and 92, respectively) of the coupler 96. When the diodes 94 and 98 are reverse biased to be in the non-conductive state, a reflection RF signal is produced through the transmission coupled pairs 82–84 and 86–88 to interfere with the incident RF signal to cause destructive interference to occur at the input line of the quadrature coupler 76 and constructive interference to occur at the output line of the quadrature coupler 76. Conversely, when the diodes 94 and 98 are forward biased to be conductive, the characteristics of the transmission line pair 82–84 and 86–88 are changed and the destructive and constructive interferences of the incident and reflected RF waves cause a phase shift to occur with respect to time on the RF signal at the output port 4 at 80 of the quadrature coupler 76. The magnitude and direction of the phase shift, which is effected as a result of the change in state of the diodes 94 and 98, is dependent on the coupling of the transmission line pairs 82–84 and 86–88 which may be altered by changing the length of lines 84 and 86 with respect to lines 82 and 88, respectively, as exemplified by the graph of FIG. 7. For example, in the case in which a plurality of these phase shifter elements are cascaded together to form an N-bit phase shifter array, a desirable magnitude and direction of the phase shift of each of the elements of the array may be easily implemented by selectively altering the length of the appropriate transmission line of each of the matched coupled transmission line pairs of each of the phase shifter elements. The direction or sense of the phase shift of one element is relative to the direction sense of phase shift of another element in the array.

In certain high speed response cases, like for example when an N-bit phase shifter comprised of the phase shifter elements disclose supra is applied in a sampling linearizer for an FM waveform generation system, such as the one described in the aforementioned U.S. patent application Ser. No. 935,240, filed concurrently herewith, and now U.S. Pat. No. 4,160,956, the switching rates for shifting the phase between states for each element may be very close to the frequency of the RF input signal. The filtering network comprised of the stub 105 and high impedance lines 102 and 104 cooperate with the matched pair of coupled transmission lines 82–84 and 86–88 to provide sufficient mutual electrical decoupling of both the RF signal from the diode current driver and the switching signal from interfering with the matched coupled transmission line/quadrature coupler operation.

Figure 8:
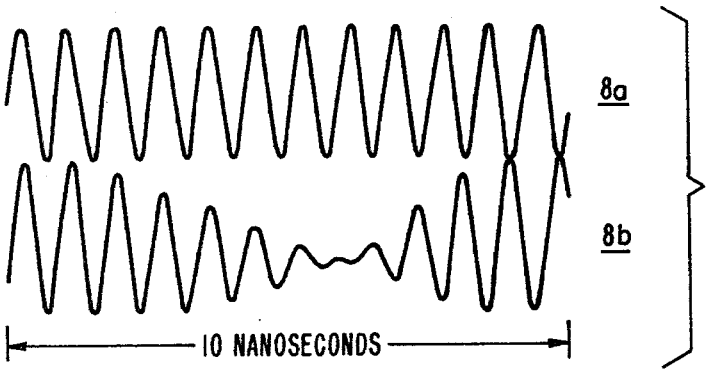
FIG. 8 is a display of two waveforms which exhibit exemplary experimental results related to the phase shifting switching speed of applicant's phase shifting circuit.

Exemplary test results of an embodiment of the phase shifter element similar to that shown in FIG. 6 are exhibited in FIG. 8. The top waveform 8A displays the RF signal at output port 4 of the quadrature coupler 76 with no change in bias of the diodes 94 and 98 and the bottom waveform 8B depicts the RF signals at output port 4 as the diodes are switched between forward (conducting) and reverse (non-conducting) bias states. With regard to this experimental example, the phase reversal occurs in less than 2 nanoseconds and the time required to switch between a steady state condition of one phase to the steady state condition of another phase was approximately 8 nanoseconds.

I claim:

1. An electrical phase shifting circuit element including a quadrature coupler branching network having an input port for receiving an electrical RF signal, an output port from which the phase shifted RF signal may be generated and first and second phase splitting ports; and two matched reflective termination networks, one being coupled to said first phase splitting port and the other being coupled to said second phase splitting port, said each matched reflective termination network comprising:

a pair of selectably coupled transmission lines being separated distributively from each other and from a first voltage potential by a dielectric material of a predetermined dielectric constant, one of said transmission lines being electrically coupled to said phase splitting port corresponding to said reflective termination network;

an electrical switching element operative to transfer between first and second switching states as governed by a switching signal, said switching element electrically connecting the other transmission line of each said pair to a second voltage potential when operated in said first switching state and electrically disconnecting said other transmission line from said second voltage potential when operated in said second switching state, said connecting and disconnecting of said other transmission line from said second voltage potential rendering a phase shift of said RF signal at the output of said quadrature coupler branching network, the magnitude and direction of said rendered phase shift being a function of the selected coupling of said pair of transmission lines; and a filtering circuit for providing mutual electrical decoupling between said switching signal governing the switching element and said RF signal conducted through the phase shifting circuit element.

2. An electrical phase shifting circuit element in accordance with claim 1 wherein in each matched reflective termination network, the coupled transmission lines have a substantially fixed separation from each other along their length of a first predetermined dimension, each of the transmission lines having a width substantially of a second predetermined dimension, both transmission lines being separated from the first voltage potential by a dielectric layer having a thickness substantially of a third predetermined dimension.

3. An electrical phase shifting circuit element in accordance with claim 2 wherein in each of matched reflective termination network, the coupling of the transmission lines is a function of a first ratio of the first predetermined dimension and the third predetermined dimension, a second ratio of the second predetermined dimension and the third predetermined dimension, the predetermined dielectric constant and the length of one transmission line with respect to the length of the other transmission line in each pair.

4. An electrical phase shifting circuit element in accordance with claim 3 wherein a desired phase shift may be rendered at the output port of the quadrature coupler branching network as a result of the electrical switching element of each matched reflective termination network switching between the first and second switching states by selecting a desired length of one transmission line of each pair of transmission lines in each of the matched reflective termination networks with respect to a preset length of the other transmission line of each pair.

5. An electrical phase switching circuit element in accordance with claim 1 wherein the first and second voltage potentials are substantially equal.

6. An electrical phase switching circuit element in accordance with claim 1 wherein the first and second voltage potential are substantially at ground potential.

7. An electrical phase switching circuit element in accordance with claim 1 wherein the electrical switching element comprises a pin diode which is operative when switched to its conducting state to connect the other transmission line to the second voltage potential and is operative when switched to its non-conducting state to disconnect the other transmission line from the second voltage potential, said conducting and non-conducting states corresponding to the first and second switching states, respectively.

8. An electrical phase shifting circuit element in accordance with claim 1 wherein the switching elements of the matched reflective termination networks are governed concurrently by the same switching signal.

9. An electrical phase shifting circuit element in accordance with claim 8 including an input electrical junction for receiving the switching signal, and wherein the filtering circuit of the matched reflective termination networks comprises a high impedance line coupled between said input electrical junction and the other transmission line for each respective termination network and a common low impedance stub coupled to said input electrical junction at one end thereof, said stub having a length approximately equal to one-quarter wavelength of the desired frequency of the input RF signal and being separated distributively from the pairs of transmission lines, quadrature coupler, said high impedance lines, and first and second voltage potentials by the dielectric material, each high impedance line having a length approximately equal to said one-quarter wavelength dimension and being separated distributively from said stub, quadrature coupler, and first and second voltage potentials by the dielectric material.

10. An electrical phase shifting element in accordance with claim 1 wherein the length of at least one transmission line in each pair of transmission lines is substantially equal to one-quarter wavelength of the desired frequency of the input RF signal, wherein the other transmission line in each pair may be selected to have a desired length in the range of 0 to said one-quarter wavelength dimension, and wherein the phase shift of said RF signal at the output port of the quadrature coupler branching network rendered by said switching element switching between first and second switching states has a magnitude and direction relative to the desired length selected for the other transmission line in each pair.

11. An electrical phase shifting circuit element including a quadrature coupler branching network having an input port for receiving an electrical RF signal, and an output port from which the phase shifted RF signal may be generated and first and second phase splitting ports; and two matched reflective termination networks, one being coupled to said first phase splitting port and the other being coupled to said second phase splitting port, said each matched reflective termination network comprising:

a pair of selectably coupled transmission lines each having a width of a first predetermined dimension and being separated distributively from each other by a dielectric material of a predetermined dielectric constant, the separation being a second predetermined dimension, said pair of transmission lines being further separated distributively from a first voltage potential by said dielectric material having a thickness of a third predetermined dimension, said pair of transmission lines having a first and second end, one of said transmission lines being electrically coupled at said first end to said phase splitting port corresponding to said reflective termination network;

a pin diode operative to transfer between a conducting and a non-conducting state as governed by a switching signal, said pin diode electrically connecting the other transmission line of each said pair at said second end to a second voltage potential when conducting and electrically disconnecting said other transmission line at said second end from said second voltage potential when non-conducting, said connecting and disconnecting of said other transmission line at said second end from said second voltage potential rendering a phase shift of said RF signal at the output port of said quadrature coupler branching network, the magnitude and direction of said rendered phase shift being a function of the selected coupling of said pair of transmission lines; and a filtering circuit for providing mutual electrical decoupling between said switching signal governing the pin diode and said RF signal conducted through the phase shifting circuit element.

12. An electrical phase shifting circuit element in accordance with claim 11 wherein the first and second voltage potentials are substantially equal.

13. An electrical phase switching circuit element in accordance with claim 11 wherein the first and second voltage potentials are substantially at ground potential.

14. An electrical phase shifting circuit element in accordance with claim 11 wherein a desired phase shift may be rendered at the output port of the quadrature coupler branching network as a result of the pin diode of each matched reflective termination network switching between conducting and non-conducting states by selecting a desired length of one transmission line of each pair of transmission lines in each of the matched reflective termination networks with respect to a preset length of the other transmission line of each pair.

15. An electrical phase shifting element in accordance with claim 11 wherein at least one transmission line in each pair of transmission lines is equal to one-quarter wavelength of the desired frequency of the input RF signal; wherein said other transmission line in each pair may be selected to have a desired length in the range of 0 to said one-quarter wavelength dimension; and wherein the phase shift of said RF signal at the output port of the quadrature coupler branching network rendered by said conduction and non-conduction states of said pin diode has a magnitude and direction relative to the desired length selected for the other transmission line in each pair.

16. An electrical phase shifting circuit element in accordance with claim 11 wherein the pin diodes of the matched reflective termination networks are governed concurrently by the same switching signal.

17. An electrical phase shifting circuit element in accordance with claim 16 including an input electrical junction for receiving the switching signal; and wherein the filtering circuit of the matched reflective termination networks comprises a high impedance line coupled between said input electrical junction and the second end of the other transmission line for each reflective termination network and a common low impedance stub coupled to said input electrical junction at one end thereof, said stub having a length approximately equal to one-quarter wavelength of the desired frequency of the input RF signal and being separated distributively from the pairs of transmission lines, quadrature coupler, said high impedance lines, and first and second voltage potentials by the dielectric material; each high impedance line having a length approximately equal to said one-quarter wavelength dimension and being separated distributively from said stub, quadrature coupler and first and second voltage potential by the dielectric material.

18. A structure for an electrical phase shifter element comprising:

a first layer of conducting material;

a second layer of dielectric material of a predetermined dielectric constant having one surface contiguous with said first layer, said second layer having a thickness of a first predetermined dimension;

a quadrature coupler branch network disposed on the other surface of said second layer, which is opposite the surface contiguous with said first layer, in a stripline circuit configuration, said quadrature coupler branch network having an input port for receiving an RF signal, an output port for generating the phase shifted RF signal and first and second phase splitting ports;

two matched pairs of transmission lines disposed substantially in parallel on said other surface of said second layer in a stripline circuit configuration, each transmission line having a width of stripline of a second predetermined dimension, said transmission lines of each pair being separated by said dielectric material along their length by a third predetermined dimension, each pair of transmission lines having a first and second end, one of said transmission lines in each pair being electrically coupled from said first end to said first and second phase splitting ports, respectively;

a pin diode corresponding to each pair of transmission lines, each pin diode disposed in said dielectric material in close proximity to the second end of the transmission line pair corresponding thereto, the cathode of each pin diode being electrically coupled to said first layer and the anode of each pin diode being electrically coupled to the second end of the other transmission line of the pair corresponding thereto;

an electrical contact junction disposed on said other surface of said second layer located approximately midway between the second ends of said pairs of transmission lines;

two high impedance striplines disposed on said other surface of said second layer, one high impedance stripline coupling the electrical junction with the other transmission line at said second end of one pair of transmission lines and the other high impedance stripline coupling the electrical junction with the other transmission line at said second end of the other pair of transmission lines; and a low impedance stripline stub disposed on said other surface of said second layer being coupled to said electrical junction and extending over said other surface a predetermined distance substantially parallel with and separated distributively from said pairs of transmission lines by said dielectric material.

19. A structure for an electrical phase shifter element in accordance with claim 18 wherein the length of at least one transmission line in each pair of transmission lines is substantially equal to one-quarter wavelength of the desired frequency of the input RF signal, and wherein the other transmission line may be selected to have a desired length in the range of 0 to said one-quarter wavelength dimension.

20. A structure for an electrical phase shifter element in accordance with claim 19 wherein the low impedance stripline stub has a predetermined distance of approximately one-quarter wavelength of the desired frequency of the input RF signal, and wherein each high impedance stripline has a length approximately equal to said one-quarter wavelength dimension.

* * * * *